US005361899A

United States Patent [19]

Reimers

[11] Patent Number: 5,361,899

[45] Date of Patent: Nov. 8, 1994

[54] GOLF BAG WITH INTERSECTING CIRCLES CROSS SECTION

[76] Inventor: Eric W. Reimers, 1235 Starwood, Missoula, Mont. 59802

[21] Appl. No.: 184,472

[22] Filed: Jan. 21, 1994

[51] Int. Cl.[5] ..... A63B 55/06

[52] U.S. Cl. ..... 206/315.6; D3/255; 206/315.7

[58] Field of Search ..... 206/315.3, 315.6, 315.7; D3/254, 255, 259

[56] References Cited

U.S. PATENT DOCUMENTS

| | | | |
|---|---|---|---|
| Re. 33,203 | 4/1990 | Reimers | 206/315.5 |
| 1,492,253 | 4/1924 | Levine | 206/315.3 |
| 1,555,019 | 9/1925 | MacDonald | 206/315.3 |
| 1,607,803 | 11/1926 | Schank | 206/315.3 |
| 3,842,876 | 10/1974 | Cristelli | 206/315.6 X |
| 4,172,484 | 10/1979 | Henning | 150/1.5 B |
| 4,852,896 | 8/1989 | Mills | 206/315.3 X |
| 5,226,533 | 7/1993 | Antonious | 206/315.6 |

*Primary Examiner*—Allan N. Shoap
*Assistant Examiner*—Christopher McDonald
*Attorney, Agent, or Firm*—Michael J. Hughes; Bradley T. Sako

[57] ABSTRACT

A golf bag (10) with a supporting structure (14) which includes a collar (18), base (32), and dowels (20 and 26). The collar 18 and base 32 are unitary structures in the shape of three intersecting rings (34, 36 and 38). The supporting structure (14) is surrounded by an enclosing fabric (16). A first ring (34) is smaller in diameter than a second ring (36) which is smaller in diameter than a third ring (38). As the bag is transported the force of gravity directs the weight of carried clubs in a single direction.

20 Claims, 4 Drawing Sheets

GOLF BAG WITH INTERSECTING CIRCLES CROSS SECTION

TECHNICAL FIELD

This invention relates generally to carrying bags and more particularly to golf bags for organizing and transporting a set of golf clubs.

BACKGROUND ART

Among the many challenges presented in the game of golf is club selection. This challenge is ever present whether the golfer is teeing off, hitting a fairway shot, or making a valiant attempt to extricate himself or herself from an unfavorable position. The variety of holes, conditions, and golfer skill levels and strengths, presents a nearly infinite variety of situations which the golfer must address with but one bag of clubs.

The importance of club choice makes golf bag design critical, particularly to those golfers who prefer carrying their clubs within a golf bag as they traverse a course. Improper arrangement of clubs or an off-balance bag can ruin a game of golf. As the golf bag is slung over the shoulder and the golfer moves from hole to hole, off-balance arrangement of clubs can make maneuvering awkward and uncomfortable. Balance is also important when transporting a bag with a manual or automated golf bag cart. In addition, golf bags that are roughly circular in horizontal cross section can be uncomfortable and awkward between the arm and body.

Golf bags are typically designed in a generally tubular shape, having a collar, a base portion, and a surrounding side portion joining the collar to the base. Nearly all golf bags have a shoulder strap permanently attached to the side portion by stitching, adhesive, riveting or the like. The bag is carried with the strap slung over the shoulder and the bag suspended between the golfer's arm and body. Many bags have an additional carrying handle along the spine of the bag.

Golf bags come in "stiff" and "soft" sided variations. In golf bags with "stiff" sides the surrounding side portion is manufactured from a rigid or semi-rigid material which substantially maintains its shape against outside forces. In these bags the sides themselves provide the shape and structural strength of the golf bag. Although structurally stronger than soft sided bags, stiff sided bags tend to be less comfortable as the large, stiff, usually cylindrical bag portion contacts the golfer's sides and arms as the bag is carried. In addition, stiff sided bags are typically heavier due to the materials of construction.

A second type of design includes "soft" sided bags. These bags often, but not always, include one or more rigid dowels connecting the collar to the base which give the bag structure. The side portions are constructed of a soft material such as nylon. This material is connected to the collar and base by sewing, glue, rivets or the like. Soft sided bags are preferred by many golfers for their superior comfort when the bag is contacting the golfers body. The collapsibility of the material causes it to conform to the golfer's arms and body as it is carried. The soft side materials can make the soft sided bag considerable lighter as well. Despite these advantages, a soft sided bag employing a standard collar can have drawbacks. Further, the capacity, both in clubs and in accessories is often less for soft sided bags.

Golf bag collars provide structure to the bag but can have additional functions as well. While some simply provide additional decorative value, others provide organizational value. Many collar designs partition the area within a roughly circular collar into a number of sections. One type of partition creates a "honeycomb" interior as set forth in U.S. Pat. No. 4,172,484 issued to Luther T. Henning. A second example is taught by U.S. Pat. No. 4,685,561, issued to the Applicant, Eric W. Reimers. This patent illustrates a golf bag with a collar subdivided into four different sections, the golf bag including interior partitions for organizational advantages. Both designs provide the golfer with organizational capabilities but tend to distribute the weight of the clubs throughout the bag and do not focus the force in a single direction as the golf bag is carried.

Generally circular, partitioned golf bag collars can be uncomfortable as well. If the clubs are evenly distributed among the partitions, they form a roughly cylindrical array of shafts which can be as uncomfortable as stiff sided golf bag designs.

None of the prior art effectively provides a golf bag design that successfully addresses the above mentioned concerns.

SUMMARY OF THE INVENTION

Accordingly, it is an object of the present invention to provide a golf bag design that concentrates the weight of the clubs in a single direction for additional stability when the golf bag is carried.

It is a further object of the present invention to provide a golf bag with a shape that fits comfortably between the arm and torso when carried.

It is yet another object of the present invention to provide a golf bag with organizational capabilities via a collar with club insertion apertures aligned along a common axis.

It is yet another object of the present invention to provide a golf bag with improved access to clubs via a collar with "stair-stepped" apertures aligned along a common axis.

It is yet another object of the present invention to provide a golf bag with greater aesthetic appeal by providing a more streamlined design.

Briefly, a preferred embodiment of the present invention is golf bag with a unique collar and base design. The collar and base are unitary structures having the shape of three intersecting rings of differing sizes. The origin points of each ring are aligned on a longitudinal axis plane with the carrying strap.

In the collar, the first ring is the smallest. The second ring is larger than the first, and the third ring larger than the second. The second ring is offset from the first ring and has a generally circular shape with a section missing where it intersects with the first ring. The third ring is offset from the second ring in the same direction the second ring is offset from the first. The third ring has the same general shape as the others, only larger, with a missing section of the third ring formed by the intersection of the third ring with the second ring.

The base structure is similar in shape to the collar but also includes a solid bottom portion. In the preferred embodiment of the present invention, the surrounding bag sides are of a soft material, such as nylon, and extend from the collar to the base. To maintain structural integrity the bag also includes at least two dowels extending between the collar and the base. The dowels are also aligned on the longitudinal axis plane and are permanently attached to the base and extend upward to the collar.

The interior of the preferred embodiment of the bag includes two partitions which extend the entire length of the bag. These partitions ensure that the bag has a cross section that roughly follows the collar design the entire length of the bag. The resulting structure, including the collar and base, resembles three hollow cylinders that intersect along their length forming three interior compartments. The compartments include a small, medium and large compartment corresponding to the first, second and third rings of the collar, respectively. The cylinders are open at the top for the insertion of clubs into one of the three compartments, and closed at the bottom by the solid base bottom. An alternate configuration may be molded in the form of discrete, cylindrical (generally) members secured together.

The preferred embodiment of the present invention also includes two pouches sewn on the outsides of the bag for carrying other golfing paraphernalia.

An advantage of the present invention is that it provides a golf bag with added stability due to the concentration of club weight in a single direction.

Another advantage of the present invention is that it provides a golf bag with organizational capabilities.

A further advantage of the present invention is that it provides a golf bag which fits comfortably between the arm and torso of the golfer when carried.

Yet another advantage of the invention is that it provides a unique visual aspect which is distinctive and easily spotted by the golfer.

Still another advantage of the invention is that it is laterally compact and easily stored, while retaining stability in an upright orientation.

A further advantage of the invention is that the base provides defined cavities for receiving the ends of the club shafts and preventing shifting during usage, thus maintaining the balance.

Yet another advantage of the invention is that it provides a more stable configuration for golf bag stands and/or carts.

These and other objects and advantages of the present invention will become clear to those skilled in the art in view of the description of the best presently known mode of carrying out the invention and the industrial applicability of the preferred embodiment as described herein and as illustrated in the several figures of the drawing.

BEST MODE OF CARRYING OUT THE INVENTION

The preferred embodiment of the present invention is a golf bag with a supporting structure including a unique collar and base design that concentrates the weight of carried clubs in a single direction.

Figure 1:
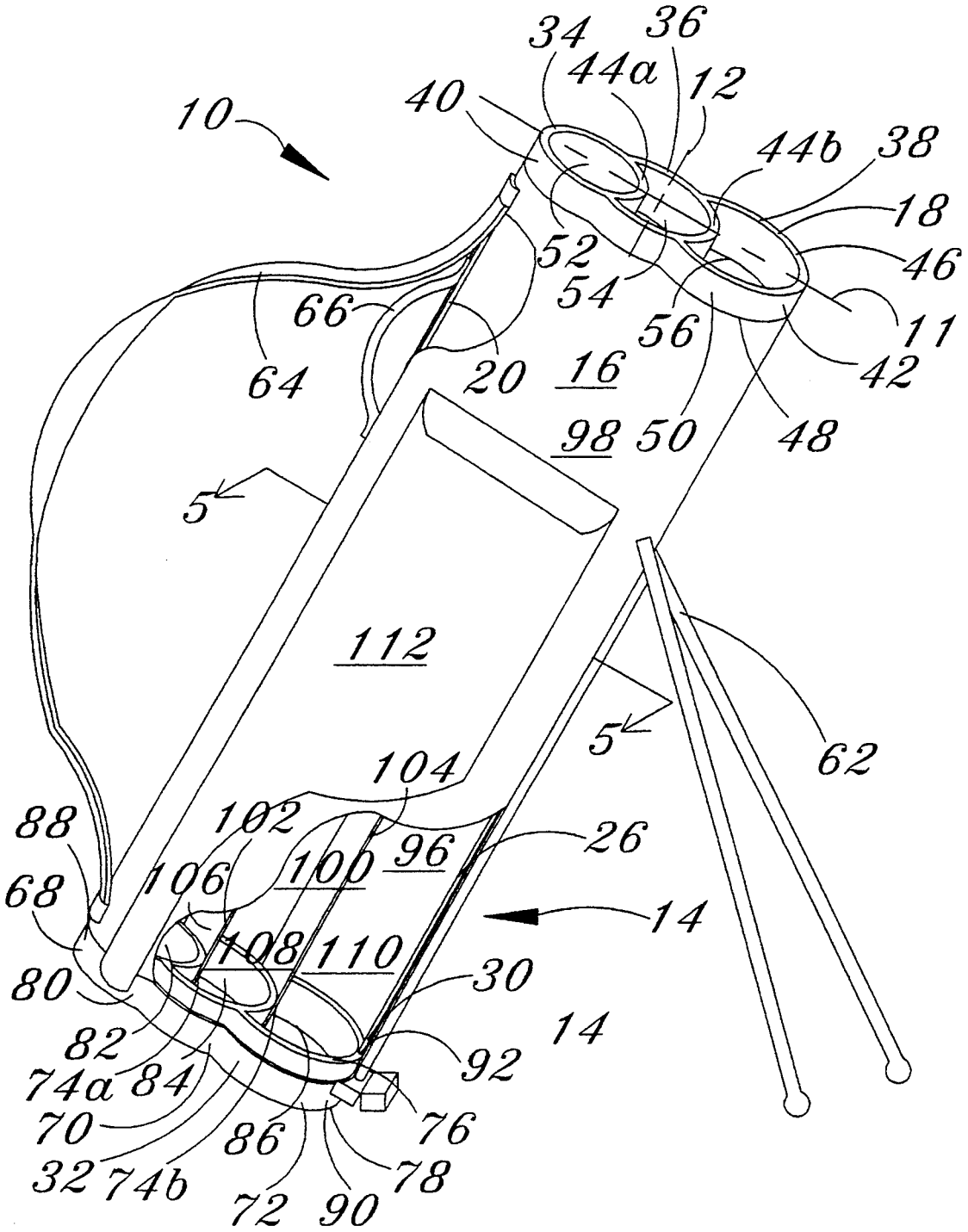
FIG. 1 is a partially cut away perspective view of the inventive bag.

Referring now to FIG. 1, the preferred embodiment of the present invention is illustrated in a partially cutaway view and is designated by the general reference character 10. The preferred embodiment is a bag 10 of "soft-sided" design which is formed about a longitudinal axis plane 11 extending through the center thereof and a lateral axis plane 12 which is perpendicular to the longitudinal axis plane 11. The preferred embodiment of the bag 10 is effectively symmetrical about the longitudinal axis plane 11. As shown in FIG. 1 the bag 10 has a supporting structure 14 surrounded by an enclosing fabric 16. The supporting structure 14 includes an open collar 18, a spine dowel 20 including a collar end 22 and a base end 24, a front dowel 26 including a front collar end 28 and front base end 30, and a closed base 32.

Figure 2:
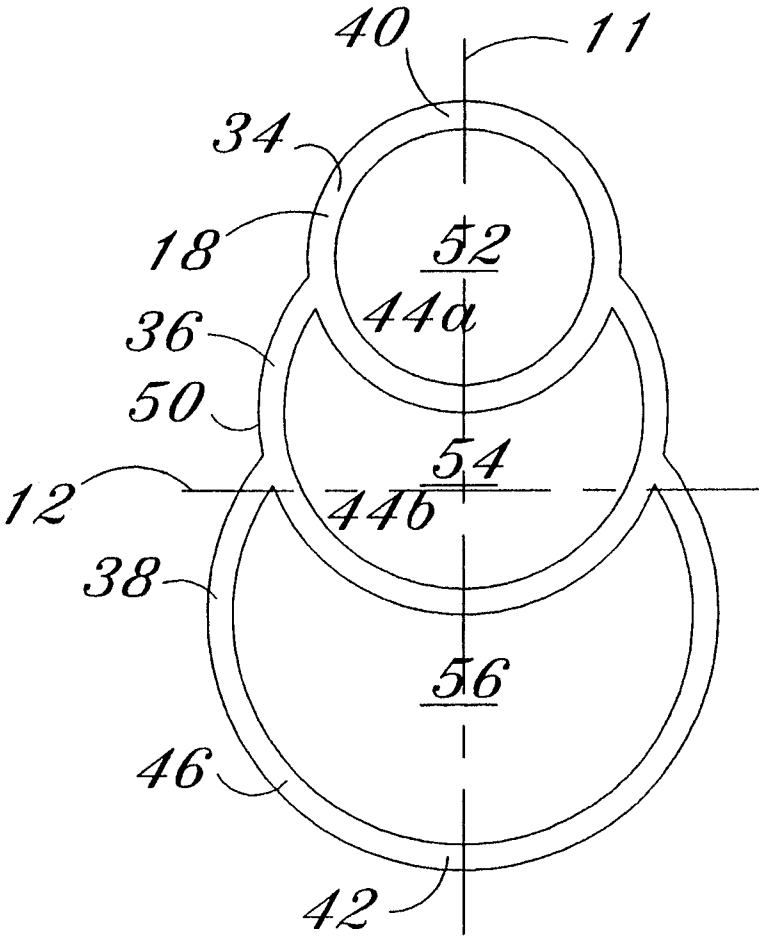
FIG. 2 is top plan view of the collar of the golf bag.

The collar 18 is illustrated in a top view in FIG. 2. In the preferred embodiment the collar 18 is a unitary structure formed of high impact plastic, although one skilled in the art would readily recognize any material of sufficient strength to serve the structural functions of the collar 18 would suffice. As shown in FIGS. 1 and 2, the collar 18 is shaped to have three portions, a first ring 34 intersecting a second ring 36 which intersects a third ring 38. In the preferred embodiment all three rings (34, 36, and 38) are coplanar, and have progressively larger diameters. The first ring 34 is smaller in diameter than the second 36, and the second 36 is smaller in diameter than the third 38. As is best shown in FIG. 2, the second 36 and third 38 rings are not completely circular, but have the form of a circle with a section missing. The second ring 36 has a section missing where it intersects the first ring 34, and the third ring 38 has a section missing where it intersects the second ring 36. As is also illustrated in FIG. 2, the centers of each of ring are aligned along the longitudinal axis plane 11. For the purposes of discussion, the collar 18 is shown to have a back extent 40 and a front extent 42, the back extent 40 being the rear-most portion of the first ring 34 (intersecting the longitudinal axis plane 11), and the front extent 42 being the foremost portion of the third ring 38 (intersecting the longitudinal axis plane 11).

Figure 3:
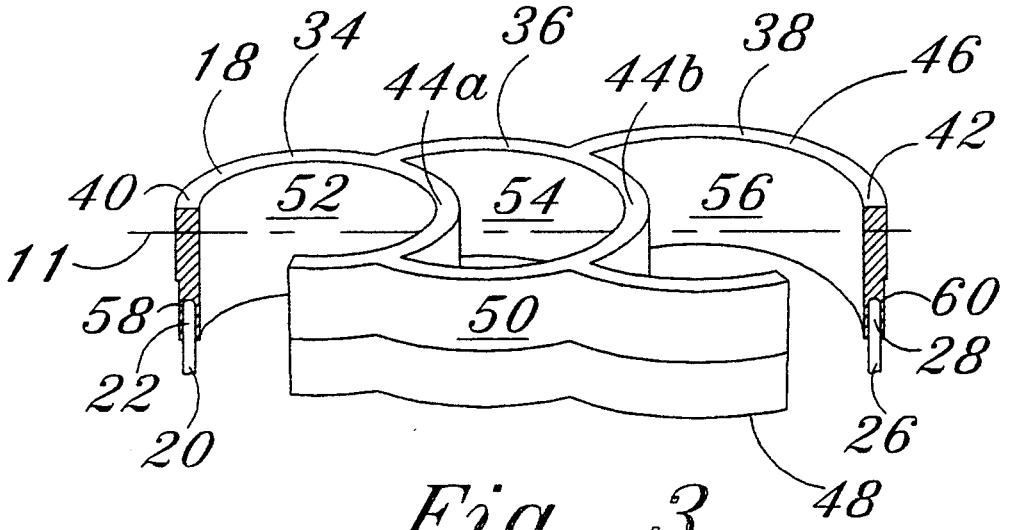
FIG. 3 is a partially cut away view of the collar of the golf bag.

The intersection of the rings (34, 36, and 38) creates two interior collar partitions 44. A first collar partition **44*a* is formed where the first ring 34 intersects the second ring 36. A second collar partition 44*b* is formed where the second ring 36 intersects the third ring 38. As shown in FIGS. 1 and 3, the intersection and height of the rings (34, 36, and 38) results in a unitary collar 18 with a top surface 46, a bottom surface 48, a surrounding side surface 50, and three club insertion apertures (52, 54 and 56); a first aperture 52 corresponding to the first ring 34, a second aperture 54 corresponding to the second ring 36, and a third aperture 56 corresponding to the third ring 38**.

The cut away view of FIG. 3 shows that the collar 18 also includes a spine dowel slot 58 for receiving the collar end 22 of the spine dowel 20 and a front dowel slot 60 for receiving the front collar end 28 of the front dowel 26. The front dowel slot 60 is located at the collar front 42 and the spine dowel slot 58 is located at the collar back 40. Both slots (58 and 60) have openings on the bottom surface 48 of the collar 18 and extend upward into the collar 18.

The spine dowel 20 and front dowel 26 of the golf bag 10 are constructed of rigid material in order to provide structure to the golf bag 10. As shown in FIG. 3, the spine dowel slot 58 of the collar 18 receives the collar end 22 of the spine dowel 20, while the front dowel slot 60 of the collar 18 receives the collar end 28 of the front dowel 26. Both dowels (20 and 26) are permanently attached to the collar 18 within their respective slots (58 and 60) by epoxy adhesive, in the preferred embodiment. One skilled in the art would recognize that other attachment methods, including such mechanical means as riveting or screws would be equally sufficient. The dowels (20 and 26) also provide and anchoring point for external optional structures attached to the golf bag. For example, as shown in FIG. 1, the front dowel 26 can be used to provide an anchor point for a stand mechanism 62 and the spine dowel 20 can be used to anchor a carrying strap 64 and/or a carrying handle 66. Both dowels (20 and 26) extend downward from the collar 18 and attach to the closed base 32.

Figure 4:
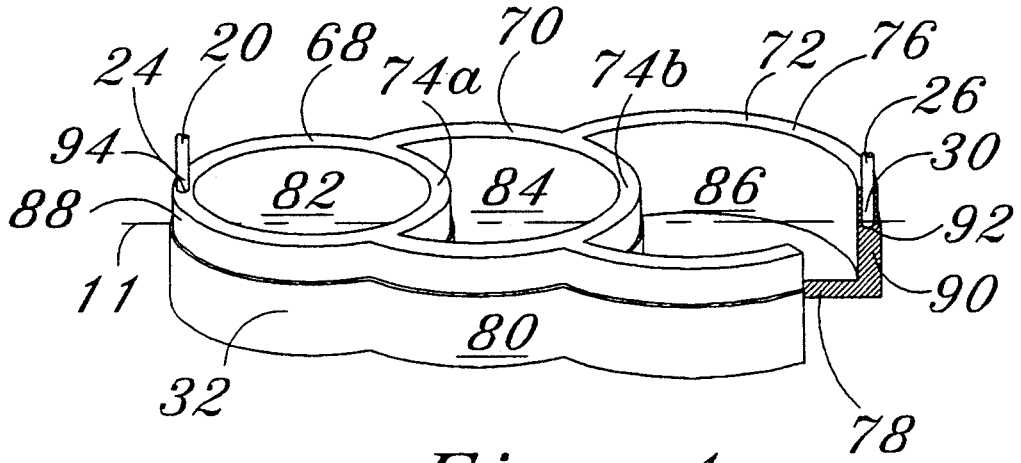
FIG. 4 is a partially cut away view of the base of the golf bag.

As is best illustrated in the partially cut away of FIG. 4, the base 32 is similar in form to the collar 18 except that it is a closed structure. Like the collar 18, the base 32 is a unitary structure with a first base ring 68 intersecting a second base ring 70 which intersects a third base ring 72. In the preferred embodiment, the first 68, second 70, and third base rings 72 have the same dimensions as the first 34, second 36, and third ring 38 of the collar 18, respectively. As in the collar structure 18, the intersection of base rings (68, 70 and 72) creates two partitions 74, a first base partition 74*a* and a second base partition 74*b*. The base 32 also has a base top surface 76, a base bottom 78, and a base side surface 80. However, unlike the collar 18 all the base rings (68, 70 and 72) are closed at one end by the solid faced base bottom 78 forming a first 82, second 84 and third cavity 86 in the base 32. Clubs are inserted through the collar apertures (52, 54 and 56) and the grip ends of the shafts will typically come into contact with, and come to rest within, the corresponding base cavities (82, 84 and 86).

Like the collar 18, the base 32 has a base back portion 88 and a base front portion 90 where the longitudinal axis plane 11 intersects the first base ring 68 and the third base ring 72, respectively. As best shown in the partially cut away view of FIG. 4, the base 32 also has a base front dowel slot 92 for receiving the front base end 30 end of the front dowel 26, and a base spine dowel slot 94 for receiving the base end 24 of the spine dowel 20. Similar to the collar 18 design, the base front dowel slot 92 is located in the base front 90 and the spine dowel slot 94 is located in base back 88. The two slots (92 and 94) receive the ends of the two dowels (20 and 26), and the two dowels (20 and 26) are permanently attached to the base 32 in the same manner that the dowels (20 and 26) are attached to the collar 18. Like the collar 18, in the preferred embodiment, the base 32 is constructed of high impact plastic, although any material of sufficient rigidity will suffice.

As illustrated in FIG. 1, the enclosing fabric 16 circumferentially extends from the surrounding side surface 50 of the collar 18 to the base side surface 80. The enclosing fabric 16 has both an interior surface 96 and an exterior surface 98. The preferred material of the enclosing fabric 16 is waterproof nylon but other durable, flexible materials such as high grade leather and vinyl will work equally well. The combination of collar 18, base 32, and enclosing fabric 16 define the interior volume of the bag 100. The preferred method of attaching the enclosing fabric 16 to the collar 18 and base 32 is a combination of both stitching and rivets, although stitching alone or riveting alone would also provide sufficient attachment.

Figure 5:
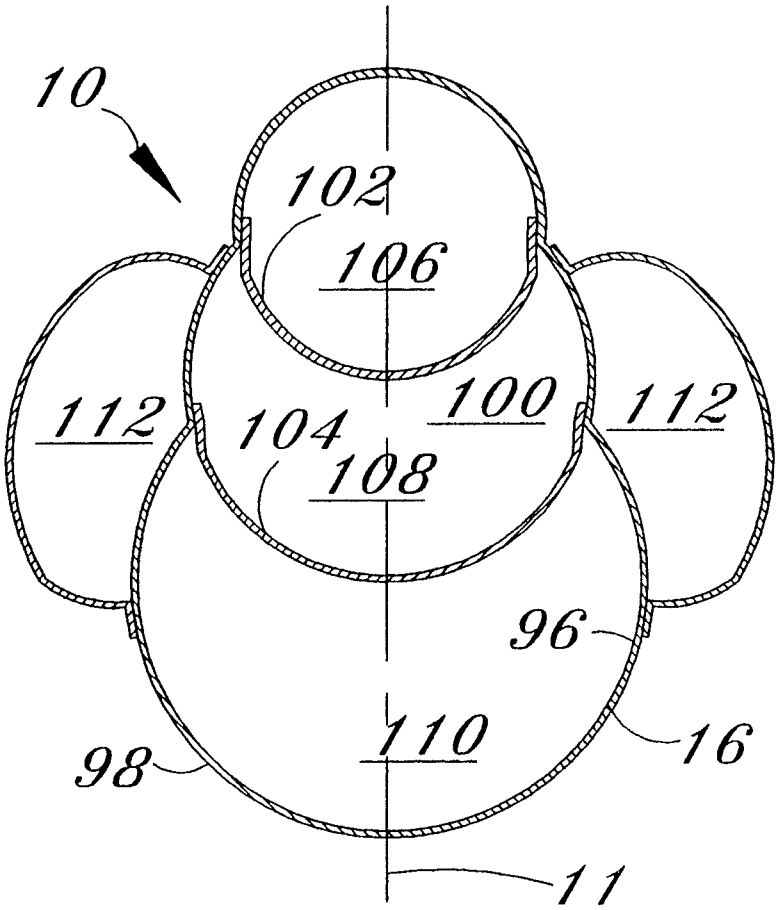
FIG. 5 is side cross sectional view of the inventive bag taken along line 5—5 of FIG. 1.

The interior of the golf bag 100 is best illustrated in the partially cut away view of FIG. 1 and the cross section of FIG. 5. As illustrated by both figures, the interior 100 includes a first fabric divider 102 and a second fabric divider 104. Both fabric dividers are roughly rectangular in shape. The interior fabric dividers (102 and 104) may be constructed of any material suitable for use as the enclosing fabric 16 or may be more rigid panels. In the preferred embodiment nylon is used. The first fabric divider 102 is attached to the first collar partition 44*a* and to the first base partition 74*a*. The first fabric divider 102 is also attached to the interior surface 96 of the enclosing fabric 16. In a like manner, the second fabric divider 104 is attached to the second collar partition 44*b*, the second base partition 74*b*, and the interior surface 96 of the enclosing fabric 16.

The two dividers (102 and 104) partition the interior volume 100 of the golf bag 10 into a first compartment 106, a second compartment 108, and a third compartment 110. The first compartment 106 is that portion of the interior intermediate the first ring 34 of the collar 18 and the first base ring 68. The second 108 and third 110 compartments are those portions of the interior volume 100 intermediate the second (36 and 70) and third rings (38 and 72) of the collar 18 and base 32. As shown in FIG. 5, the first divider 102 separates the first compartment 106 from the second 108. The second divider 104 separates the second compartment 108 from the third 110.

As is best illustrated in FIG. 5, the combination of the enclosing fabric 16 and the two dividers (102 and 104) creates a fabric cross section which maintains the general intersecting ring structure of the collar 18 and base 32 depicted in FIG. 2.

The golf bag 10 includes a carrying strap 64 for transporting the golf bag 10. In the preferred embodiment, the carrying strap 64 is attached to the back extent 40 of the collar 18 and the back extent 88 of the base 32, but could as easily be attached to the exterior surface 98 of the enclosing fabric 16 along a line joining the back extent 40 of the collar 18 with the base back extent 88, or to the spine dowel 20. A good balance may be obtained by attaching to the spine dowel 20 at a position near the center of balance of a loaded bag.

The strap 64 positioning ensures that as the bag 10 is carried the third compartment 110 is furthest forward and closest to the ground, the second compartment 108 is rearward and directly above the third 110, and the first compartment 106 is rearward and above the second 108. The arrangement of the collar 18, base 32, and fabric dividers (102 and 104) concentrates the weight of the clubs in a single downwardly angled direction. The cylindrical shape of the compartments (106, 108 and 110) forces the clubs to slide together towards the ground as the bag 10 is carried. The clubs come to rest in the portion of the compartment (106, 108 and 110) in which they are situated that is closest to the ground. The alignment of the collar ring structures (34, 36, and 38), base ring structures (68, 70 and 72), and fabric dividers (102 and 104) concentrates the weight along the longitudinal axis plane 11 which, when the bag is carried, is vertical with respect to the ground. This provides for more stable transportation of the clubs.

The arrangement of stacked, cylindrical compartments (106, 108 and 110) gives the golf bag 10 more of an inverted "V" shaped cross section than the circular cross section found in the typical bag. The "stacked cylinders" shape more naturally follows the human anatomy for greater comfort. Because the arm pivots at the shoulder, and the bag 10 is often carried under the arm, the result is that the bag 10 contacts the torso and arm over a larger area distributing the force of contact, and thereby increasing comfort.

The preferred embodiment of the present invention also includes pockets 112 attached to the exterior fabric surface 98. One such pocket is shown in FIG. 1. One skilled in the art would readily recognize that a number of pockets, of varying size, can be situated at various locations on the exterior fabric surface 98. The pockets 112 are provided for the transportation and storage of golfing paraphernalia.

Figure 7:
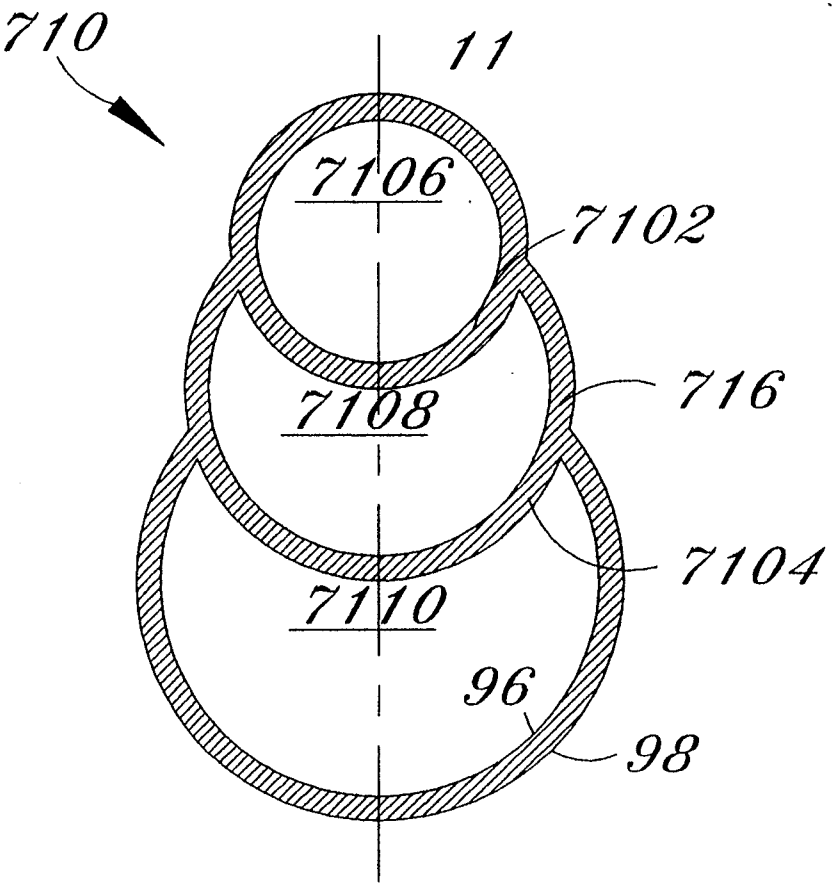
FIG. 7 is a cross sectional view of a second alternative embodiment of the present invention.
Figure 6:
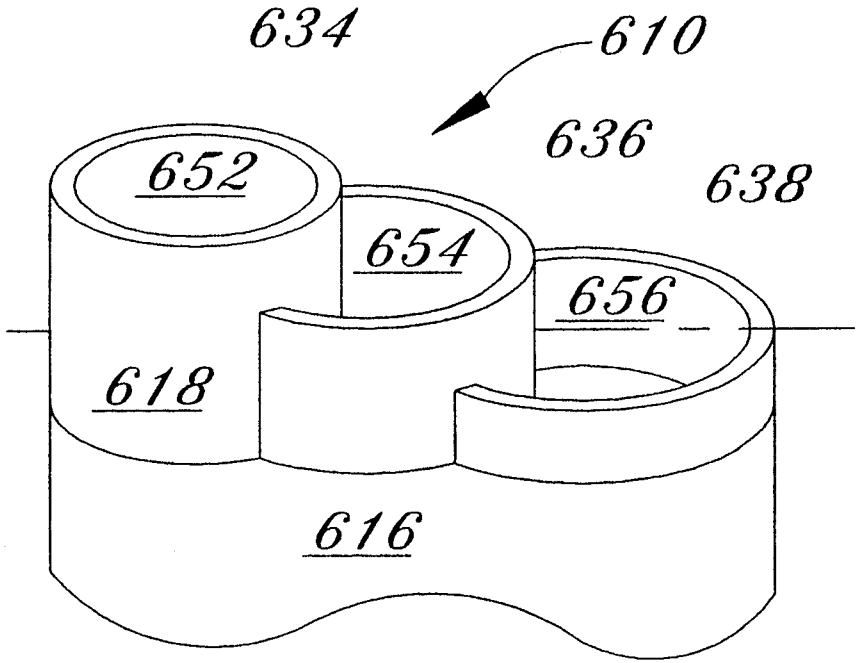
FIG. 6 is a perspective view of the collar in an alternative embodiment of the inventive bag.

Two alternate embodiments are illustrated in FIGS. 6 and 7, and are designated by the general reference characters 610 and 710, respectively. The alternative embodiments (610 and 710) have some commonalities with the preferred embodiment illustrated in FIGS. 1–5, and to this end, components which are identical to those appearing in the preferred embodiment will be referred to with the same reference number. Those components which are similar in function, but modified, will be referred to by reference numbers incorporating the original reference, with an initial digit "6" (for FIG. 6) or "7" (for FIG. 7) added.

FIG. 6 sets forth the collar 618 of the first alternate embodiment 610 and a portion of the enclosing fabric 16. The collar 618 is a unitary structure formed from a first ring 634 intersecting a second ring 636 which intersects and third ring 638. As illustrated in FIG. 6, unlike the preferred embodiment 10 which is constructed of three coplanar rings (34, 36 and 38) of equal height, the alternative embodiment employs rings (634, 636 anti 638) of varying height. The first ring 634 is greater in height than the second ring 636 which is greater in height than the third ring 638. This arrangement presents the golfer with a first club insertion aperture 652 at a higher elevation than a second club insertion aperture 654 which is higher than a third insertion aperture 656. This alternate embodiment provides additional organizational capabilities as clubs can be sorted by club length and/or presented at varying heights. It is understood the base of the alternative embodiment (not shown in FIG. 7) may provide differing elevations as well, although this will probably not be desirable.

A second alternate embodiment is illustrated in cross section in FIG. 7 and designated by the general reference character 710. Unlike the preferred embodiment 10 the second alternative embodiment 710 is not a "soft" sided design but a "stiff" sided design. This design is illustrated in the cross section of FIG. 7, which is taken through the bag 710 at the same point as line 5—5 of FIG. 1 in the preferred embodiment. As a "stiff" sided design the structural integrity of the second alternative embodiment 710 is not provided by a supporting structure, but instead utilizes an enclosing shell 716 that is a semi-rigid or rigid material. Dowels are not required, and a collar is similarly not necessary for structural support. Due to aesthetic appeal, however, the second alternative embodiment 710 may utilize a collar (not shown in the cross section). As shown in FIG. 7, the second alternative embodiment 710, like the preferred embodiment, incorporates a first divider 7102 and a second divider 7104. Unlike the preferred embodiment however, the dividers (7102 and 7104) form a unitary structure with the enclosing fabric 716. One skilled in the art will readily recognize the dividers (7102 and 7104) could also be constructed of a "soft" material as described in the preferred embodiment 10 and attached to the "stiff" enclosing shell 716 by adhesive, stitching, riveting or the like.

As a unitary structure the second alternative embodiment 710 can be conceptualized as three, parallel, intersecting, cylindrical compartments (7106, 7108 and 7110) disposed along, and bilaterally symmetrical about, the longitudinal axis plane 11. The first compartment 7106 has a smaller diameter than the second compartment 7108 which has a smaller diameter than the third compartment 7110. All three compartments are closed at one end and open at the opposing end.

Various other modifications may be made in the dispositions of the cylindrical compartments (7106, 7108 and 7110) of the second alternative embodiment 710, and the collar (18 and 618) and base 32 designs of the preferred 10 and first alternative 610 embodiments. For example the order of rings and cylinders may be reversed or alternated along the longitudinal axis plane 11, resulting in designs having club insertion apertures of decreasing or alternating diameters (as opposed to simply increasing diameters as illustrated in FIGS. 1–7). Along the same lines, the dividers (102 and 104) need not span the entire length of the base in either a "soft" sided bag 10 or a "stiff" sided bag 710.

One skilled in the art would also readily recognize that the collar 18 and base 32 need not be formed from perfectly circular rings (34, 36 and 38), and that the compartments (106, 108 and 110) need not necessarily be cylindrical. As long as each ring or compartment (in cross section) has a portion that is bowed along the longitudinal axis 11 in the direction of the collar front extent 42, club weight will be effectively directed in a common direction, and the accompanying advantages retained. Likewise, it is clear the bag need not be limited to three rings and three compartments. Designs employing less than or more than three rings and compartments can be constructed to appeal to those desiring less or more organizational capabilities.

In addition to the above mentioned examples, various other modifications and alterations of the dimensions, materials, orientation and usages may be made without departing from the invention. Accordingly, the above disclosure is not to be considered as limiting and the appended claims are to be interpreted as encompassing the entire spirit and scope of the invention.

INDUSTRIAL APPLICABILITY

The inventive golf bag 10 is intended to be used by a golfer to transport a set of golf clubs. The bag is carried by suspending the bag from the shoulder by the strap 64, or by grasping the handle 66. As the bag 10 is carried it rests between the golfers arm and torso at an acute angle with respect to the ground. The force of gravity in conjunction with the unique cylindrical shape of each compartment (106, 108, and 110) forces the clubs towards the bottom and front of each compartment. Each compartment (106, 108, and 110) is aligned with respect to the ground as the bag 10 is carried, which concentrates the weight of each compartment in a single direction, primarily vertical with respect to-the ground. This provides greater stability as the bag 10 is carried.

The inventive bag 10 provides unique advantages when used in conjunction with a bag stand 62 which deploys the bag 10 at an angle with respect to the ground. As the golfer sets the bag 10 on the ground and activates the stand mechanism 62, the bag 10 begins to tilt and the clubs collect in the bottom of each compartment. Once in the tilted "stand" position, club weight is directed in a single direction, and moderate forces will not upset the weight distribution as such forces would have to overcome the inertia of the settled clubs.

The bag 10 provides additional stability in motorized and manually powered golf bag cart applications as well. The flat bottom provides stability when vertically aligned, while if the bag 10 is disposed at an angle within such a cart, the unique bag design ensures that direction changes in the cart as it is moved across the golf course are less likely to shift club position and thus upset the balance of the cart. Similar to the stand application described in the above paragraph, any forces caused by direction changes in the cart must overcome the inertia of the settled clubs to change the club positions and offset the balance of the bag 10.

Golfers may place different types of clubs (i.e. woods, irons and putters) within each of the apertures (52, 54 and 56) for organizational advantages. Alternatively, the "stair-stepped" collar embodiment 618 is particularly useful for arrangement by club length.

In addition to increased stability, and organizational advantages, the unique shape of the golf bag 10 provides greater comfort for the golfer. Embodiments utilizing stacked, cylindrical compartments (106, 108, and 110) of decreasing diameters, conform more naturally to the shape of the human body. The portions of the bag 10 that contact the body and arm are distributed over a greater area than the typical bag with a single cylindrical or near cylindrical cross section.

For the above reasons, and others, it is expected that the golf bag device 10 of the present invention will have widespread industrial applicability. Any golfer seeking additional stability, unique organizational capabilities, and comfort will appreciate the present invention. Therefore, it is expected that the commercial utility of the present invention will be quite extensive.

I claim:

1. A golf bag for transporting and organizing golf clubs comprising:

a unitary collar structure having the shape of three intersecting rings, a first ring having a first center and a smaller diameter than a second ring, the second ring having a second center and a smaller diameter than a third ring having a third center, the second ring having a section missing where the second ring intersects the first ring, the third ring having a section missing where the third ring intersects the second ring, a first divider portion being the section of the first ring that intersects the second ring, a second divider portion being the section of the second ring that intersects the third ring, the centers of the first, second, and third rings being aligned within a common axis plane;

a closed unitary base structure having a bottom portion for providing a closed end to said golf bag; and support means for providing structure to the golf bag extending intermediate said collar and said base.

2. The golf bag of claim 1 wherein said support means includes at least one dowel, each dowel having a collar end and a base end, the collar ends being attached to said collar by dowel attachment means, the base ends attached to said base by the base dowel attachment means;

said collar further includes collar dowel attachment means for attaching at least one dowel end to said collar; and said base includes a base dowel attachment means for attaching at least one dowel end.

3. The golf bag of claim 1 further including:

an enclosing material extending from said collar to said base for defining a bag interior and bag exterior.

4. The golf bag of claim 3 wherein:

said unitary base structure has the same structure of said collar, including a first base ring, a second base ring, and a third base ring, each base ring having a closed end forming the bottom portion of said base.

5. The golf bag of claim 4 further including:

a first interior divider attached to the first divider portion of said collar, the interior surface of said enclosing material, and the first base divider portion;

a second interior divider attached to the second divider portion of said collar, the interior surface of said enclosing material, and the second base divider portion; wherein the first and second interior dividers separate the bag interior into a first, second and third compartment, each compartment having a roughly cylindrical shape, the first compartment situated intermediate the first ring and the first base ring, the second compartment intermediate the second ring and second base ring, and the third compartment intermediate the third ring and the third base ring.

6. The golf bag of claim 4 wherein:

said collar is composed of high impact plastic; and said base is composed of high impact plastic.

7. The golf bag of claim 3 further including:

a first interior divider attached to the first divider portion of said collar and the interior surface of said enclosing material, the first interior divider extending into the bag interior creating a first cylindrical compartment intermediate the first ring and said base;

a second interior divider attached to the second divider portion of said collar and the interior surface of said enclosing material, the second interior divider extending into the bag interior creating a second and third cylindrical compartment, the second compartment being intermediate the second ring and said base, the third compartment being intermediate to the third ring and said base.

8. The golf bag of claim 5 wherein:

said first interior divider is also attached to said base, said first interior divider extending from the first divider portion of said collar to said base.

said second interior divider is also attached to said base, said second interior divider extending from the second divider portion of said collar to said base.

9. The golf bag of claim 1 wherein:

said support means is created by an enclosing shell; and the enclosing shell is a rigid preformed material.

10. A golf bag for transporting and organizing golf clubs comprising:

a first cylindrical portion including a first surrounding material, a first portion open end and a first portion closed end, said first cylindrical portion having a first diameter and a first centrally disposed axis disposed within a longitudinal axis plane;

a second cylindrical portion including a second surrounding material, a second portion open end and a second portion closed end, said second cylindrical portion having a second diameter and a second centrally disposed axis parallel to the first axis and disposed within the longitudinal axis plane, said second cylindrical portion being attached to, and intersecting said first cylindrical portion, the second surrounding material missing a section where the first and second cylindrical portions intersect;

a third cylindrical portion including a third surrounding material, a third portion open end and a third portion closed end, said third cylindrical portion having a third diameter and a third centrally disposed axis parallel to the first and second axes and disposed within the longitudinal axis plane, said third cylindrical portion being attached to, and intersecting said second cylindrical portion opposite to said first cylindrical portion, the third surrounding material missing a section where the second and third cylindrical portions intersect; and carry means attached to one of said cylindrical portions for transporting the golf bag.

11. The golf bag of claim 10 wherein:

the first diameter of said first cylindrical portion is smaller than the second diameter of said second cylindrical portion, and the second diameter is smaller than the third diameter of said third cylindrical portion.

12. The golf bag of claim 10 wherein:

the first portion open end, the second portion open end, and the third portion open end form a rigid collar structure;

the first portion closed end, the second portion closed end, and the third portion closed end form a rigid base structure.

13. The golf bag of claim 12 wherein:

said first cylindrical portion includes one or more support dowels for providing structure to the golf bag and the first surrounding material is a flexible fabric;

the second surrounding material is a flexible fabric; and the third cylindrical portion includes one or more support dowels for providing structure to the golf bag and the third surrounding material is a flexible fabric.

14. The golf bag of claim 10 wherein:

the first, second, and third surrounding materials are resilient but rigid for providing structure to the golf bag.

15. The golf bag of claim 10 wherein:

said carry means is attached to said first cylindrical portion; wherein as the golf bag is carried said third cylindrical potion is disposed below said second cylindrical portion, and said second cylindrical portion is disposed below said first cylindrical portion.

16. A golf bag for transporting and organizing golf clubs comprising:

a unitary collar of rigid construction having a plurality of club insertion apertures extending through said collar for accepting golf clubs, each aperture having a shape that includes a curved portion having an apex, the curved portions being curved in the same direction such that the apexes are aligned along a common axis disposed on a longitudinal plane that is perpendicular to said collar;

a unitary base of rigid construction having a bottom;

surrounding support structure attached to said unitary collar and attached to said unitary base;

carrying means attached to said surrounding support structure for transporting the golf bag; wherein said unitary base and said surrounding support structure define a bag interior; and gravity urges the inserted golf clubs in each aperture to gather against the curved portion at the apexes when the bag is tilted such that the curved portions are concave with respect to the force of gravity.

17. The golf bag of claim 16 wherein:

said surrounding support structure is a rigid, resilient material.

18. The golf bag of claim 16 wherein:

said surrounding support structure includes a plurality of support dowels enclosed by a flexible material.

19. The golf bag of claim 16 wherein:

said unitary base has a plurality of club cavities for accepting golf clubs, each cavity opening into the bag interior and terminating in the base bottom, the cavities each having a shape that includes a curved cavity portion having a base apex, the base apexes being aligned along a common base axis disposed along the longitudinal plane so that as the bag is carried, gravity forces the golf clubs in each cavity to gather against the apexes in a common direction.

20. The golf bag of claim 16 further including:

a plurality of interior dividers, attached to the curved portion of said collar, extending into the bag interior and creating a plurality of compartments therein; wherein each compartment is characterized by having a cross section with a curved interior having an interior apex aligned along an interior axis disposed in the longitudinal plane.

* * * * *